US010454223B2

(12) United States Patent
Bayar et al.

(10) Patent No.: US 10,454,223 B2
(45) Date of Patent: Oct. 22, 2019

(54) CONNECTOR ASSEMBLY AND RELATED METHODS AND ASSEMBLIES

(71) Applicant: ETL Systems Limited, Hereford and Worcester (GB)

(72) Inventors: Esen Bayar, Northwood (GB); Daniel Mapp, Hereford and Worcester (GB)

(73) Assignee: ETL SYSTEMS LIMITED, Hereford and Worcester (GB)

( * ) Notice: Subject to any disclaimer, the term of this patent is extended or adjusted under 35 U.S.C. 154(b) by 0 days.

(21) Appl. No.: 15/536,609

(22) PCT Filed: Dec. 9, 2015

(86) PCT No.: PCT/GB2015/053769

§ 371 (c)(1),
(2) Date: Jun. 16, 2017

(87) PCT Pub. No.: WO2016/097696

PCT Pub. Date: Jun. 23, 2016

(65) Prior Publication Data

US 2017/0331230 A1 Nov. 16, 2017

(30) Foreign Application Priority Data

Dec. 17, 2014 (GB) ..... 1422526.2

(51) Int. Cl.
*H01R 13/648* (2006.01)
*H01R 13/6598* (2011.01)
(Continued)

(52) U.S. Cl.
CPC ..... *H01R 13/6598* (2013.01); *H01R 13/405* (2013.01); *H01R 13/629* (2013.01); *H01R 24/50* (2013.01)

(58) Field of Classification Search
CPC . H01R 13/6598; H01R 13/405; H01R 13/629
See application file for complete search history.

(56) References Cited

U.S. PATENT DOCUMENTS 5,577,935 A 11/1996 Harting
6,676,443 B1 * 1/2004 Wang ..... H01R 13/7031 439/188

(Continued)

FOREIGN PATENT DOCUMENTS

EP 2437358 4/2012
WO 2012082518 6/2012

OTHER PUBLICATIONS

Publication and Search Report for PCT/GB2015/053769 published Jun. 23, 2016 (38 pages).

(Continued)

*Primary Examiner* — Xuong M Chung Trans
(74) *Attorney, Agent, or Firm* — Conley Rose, P.C.

(57) ABSTRACT

The present application describes a connector assembly, a circuit board assembly, a cable assembly and to a method of manufacturing a connector assembly. A connector assembly comprises a shroud; and a plurality of co-axial radio frequency connectors at least partially received in the shroud such that the shroud extends around each radio frequency connector and between adjacent radio frequency connectors. The shroud comprises at least one piece of radiowave absorption material arranged to absorb radio frequency energy leaking or dispersing from the radio frequency connectors in use. Another connector assembly comprises a body, a plurality of radio frequency connectors at least partially received in the body, and a conductive foil integrally formed with the body and partially extending beyond the body.

19 Claims, 9 Drawing Sheets

(51) Int. Cl.

| | |
|---|---|
| ***H01R 13/405*** | (2006.01) |
| ***H01R 24/50*** | (2011.01) |
| ***H01R 13/629*** | (2006.01) |

(56) References Cited

U.S. PATENT DOCUMENTS

| | | | | |
|---|---|---|---|---|
| 6,948,977 | B1 * | 9/2005 | Behrent | H01R 23/688 439/581 |
| 9,225,120 | B2 * | 12/2015 | Barr | H01R 13/6585 |
| 2004/0001299 | A1 | 1/2004 | van Hanster | |
| 2007/0290765 | A1 | 12/2007 | Hsu | |
| 2008/0171973 | A1 | 7/2008 | Tanaka | |
| 2012/0329325 | A1 | 12/2012 | Fogg | |
| 2013/0199835 | A1 | 8/2013 | Janota | |
| 2014/0030922 | A1 | 1/2014 | Schmitt | |

OTHER PUBLICATIONS

International Search Report and Written Opinion for PCT/GB2015/053769 published May 11, 2016 (17 pages).
Combined Search Report and Exam Report for GB1422526.2 dated Jun. 16, 2015 (7 pages).

* cited by examiner

CONNECTOR ASSEMBLY AND RELATED METHODS AND ASSEMBLIES

CROSS-REFERENCE TO RELATED APPLICATIONS

This application is a 35 U.S.C. § 371 national stage application of PCT/GB2015/053769 filed Dec. 9, 2015 and entitled "Connector Assembly and Related Methods and Assemblies," which claims priority to British Application No. 1422526.2 filed Dec. 17, 2014 and entitled "Connector Assembly and Related Methods and Assemblies," each of which being hereby incorporated herein by reference in its entirety for all purposes.

STATEMENT REGARDING FEDERALLY SPONSORED RESEARCH OR DEVELOPMENT

Not applicable.

BACKGROUND

The present invention, claimed below, relates to a connector assembly, a circuit board assembly, a cable assembly and to a method of manufacturing a connector assembly.

Embodiments have particular applicability in the field of Radio Frequency (RF) connectors having multiple ports with a high density.

There are many environments where there is a need for high-reliability, high-density Radio Frequency systems. For example, it is known to use such systems in satellite, aerospace and defence applications, e.g. ground base stations and communication systems, land and sea anti-ballistic signal processing, avionics and ground-based radar systems, and electronic countermeasures.

The ever increasing requirement for high density Radio Frequency devices has resulted in great advances in the fields of semiconductor technologies, enabling miniaturisations and the introduction of very compact devices which would otherwise not be possible. An area where there is still room for much improvement is in suitable connectors for use with such RF systems. There has been work done in the way of miniaturisation which has given way to a range of microminiaturised connectors with lock-snap mechanisms. This has resulted in multiple coaxial connectors enabling high density, multiple RF connectivity. A problem with such miniaturisation is that it becomes difficult to maintain high isolation in these high density connector assemblies. The goal of a RF line is to maintain the electric and magnetic fields between the two conductors. Due to mechanical and manufacturing constraints, perfect shielding is difficult to achieve. Therefore, part of the RF energy can leak from the transmission line which causes interference (cross talk) or even errors in a system. The leakage is dependent on the frequency as well as on the physical construction of the line. Prior art systems have not adequately addressed how to manage RF leakage and shielding in such connector systems.

The present disclosure aims to address these problems in the known systems.

SUMMARY OF DISCLOSURE

According to a first aspect of the disclosure that is presented herein, there is provided:

a connector assembly comprising:

a shroud; and, a plurality of co-axial radio frequency connectors at least partially received in the shroud such that the shroud extends around each radio frequency connector and between adjacent radio frequency connectors;

the shroud comprising at least one piece of radiowave absorption material arranged to absorb radio frequency energy leaking or dispersing from the radio frequency connectors in use The radiowave absorption material attenuates RF energy, e.g. by converting it to heat, and greatly reduces leakage between adjacent RF connectors and thus increases the isolation of each RF connectors. This allow a high density of RF connectors within the connector assembly whilst minimising cross talk and other signal interference. Thus, the connector assembly can be miniaturised without suffering from the signal degradation problems that afflict the prior art attempts.

Thus, disclosed and exemplary embodiments provide a connector assembly where high isolation levels are maintained between all connector ports within a high density, RF connector assembly. In certain embodiments, the RF connectors may be less than 1 mm apart for instance. Nonetheless, it will be appreciated that the pitch will depend on the application and the size of the connectors to some degree. Exemplary embodiments are capable of 50 dB or more energy absorption between adjacent RF connectors.

The connector assembly may have an array of at least 4, at least 16, at least 32 or more RF connectors. These may be arranged in a single row, or more than one row for example. If more than one row is desired, a shroud can be provided for each row within the connector as described in more detail below.

The co-axial connectors comprise a central conductive element for carrying the signal surrounded by a barrel element which is typically at ground potential and shields the central element.

In an embodiment, the shroud comprises plural pieces of radiowave absorption material, at least one piece of radiowave absorption material having different RF energy absorption properties from another piece of radiowave absorption material.

In many applications a single layer of RAM will be sufficient. However there may be cases where multiple layers of RAM would be beneficial used to provide attenuations over very broad frequency range. The reason for this is that RAM can be frequency selective. What attenuates a 1 GHz RF signal extremely well will not work as well at 50 GHz for instance. Thus, the various pieces of RAM can be arranged to absorb radiation in different frequency ranges. Having multiple layers will provide multiple attenuation paths each selectively optimised to attenuate specific frequency or frequency bands.

It will be appreciated that the RF energy leakage levels are typically low, although this is significant in a high density connector assembly. Having more than one layer of RAM is anticipated as being of particular benefit in applications where the connector design is intended to cover a broad frequency spectrum, i.e. different RF connectors or the same RF connectors can carry signals containing energy over a broad frequency range.

In an embodiment, the RF connectors have a front portion for mating to a corresponding other connector and a rear portion having terminals for making electrical connection to a circuit board, wherein the shroud extends around at least the rear portion of the connector assembly.

For example, where the RF connectors are coaxial connectors comprising a central conductive element and a barrel like outer shield element, in some embodiments, the shroud may extend from the rear of the connector to overlap with at least some of the shield. In such embodiments, the shroud may also extend to adjacent to the circuit board when mounted to a circuit board in use. Thus, any gaps at the rear of the connector, where the coaxial arrangement of central conductor and outer shield transitions into terminals for mounting to the PCB, are surrounded by the shroud so that any leaking RF energy is absorbed or substantially absorbed rather than transmitted to adjacent RF connectors or to external elements. This can be particularly useful for right angled connectors where the conductive element extends beyond the shield at the rear and undergoes a 90 degree bend to connect with the PCB, which potentially leaves gaps or sharp discontinuities where RF energy can escape.

In an embodiment, a first piece of RAM of a first type is sandwiched by pieces of RAM of a second type.

In this arrangement for example the RF connectors can be disposed within the first piece of RAM, which might be for example a layer of RAM or concentric tubular pieces of RAM surrounding each RF connector, and pieces of secondary RAM, which might be layers, are positioned at the top and bottom of the first piece of RAM. Thus, the top and bottom layers can provide a safeguard against any residual RF energy that is not absorbed by the first layer from reaching the other connectors positioned adjacent the first connector.

In an embodiment, one or more piece of RAM is arranged in a layer.

This may simplify construction of the shroud by building up the shroud by layers, e.g. by moulding the shroud layers around the RF connectors.

In some exemplary embodiments, the RF connectors, or a subset of the RF connectors, are arranged in a linear array, the layers being orientated with the array. The RF connectors may sit entirely within the central layer, with one or more layer of different types on each side.

In an embodiment, the connector assembly comprises a body, the body holding the shroud and being formed from a different material to the shroud which has a relatively low ability to absorb RF energy compared with the shroud.

In an embodiment, the shroud comprises a conductive foil layer formed integrally with the connector assembly.

The foil layer helps provide shielding to the RF connectors within the shroud. This helps prevent RF energy leaking from RF connectors from reaching the environment and prevent RF energy from the environment from reaching the RF connectors.

The foil layer can also help conduct heat away from the shroud. The RAM material operates by turning RF energy into heat energy. The use of foil layers next to the surface of RAM pieces can help conduct away the generated heat and help the performance of the RAM.

The foil layer can also help with ground continuity within the connector assembly, i.e. connecting elements in the connector assembly that are intended to be at ground potential, or between the connector and external grounds.

In an embodiment, the conductive foil layer is positioned adjacent at a surface portion of at least one piece of RAM.

In an embodiment, the conductive foil layer is positioned between two adjacent pieces of radiowave absorption material.

In an embodiment, the conductive foil layer surrounds the rear portion of the connector.

In an embodiment, the conductive foil layer is wrapped around at least part of the surface of the connector assembly.

In an embodiment, the conductive foil layer extends beyond the body of the connector assembly such that it can be join to a ground plane of the circuit board or wrap over and make electrical contact with a foil layer on an adjacently positioned connector assembly.

Thus, ground continuity can be maintained between the connector and another connector or the circuit board. The flexible foil allows the grounding to be continued by conforming to a ground plane of the circuit board or to a ground layer of an adjoining connector, thus improving shielding.

In an embodiment, the conductive foil layer defines at least one pocket containing a piece of radiowave absorption material.

In an embodiment, the conductive foil layer defines plural pockets each containing a piece of radiowave absorption material, wherein the two pockets are arranged to absorb RF energy having respectively different frequencies.

Thus, different compartments can be formed each adapted to absorb RF energy in different parts of the frequency spectrum, which is useful where the signals being carried by the RF connectors have a wide bandwidth.

In an embodiment, the plural pockets are arranged to absorb RF energy from respective different subsets of the RF connectors.

Subset used here can include only one RF connector. Thus where different connectors within the shroud are adapted for carrying different signal types having energy in different portions of the RF spectrum, the layers in the shroud create separate cavities for containing RF energy leakage for the respective signal types.

In some embodiments, all foil ground layers merge within the connector itself with a single foil protruding outwards for bonding to the PCB/another connector foil.

In an embodiment, at least one piece of radiowave absorption material comprises a composite material formed from a substrate doped with conducting particles.

In an embodiment, at least two radiation absorption material pieces have different RF energy absorption properties by having different types, densities, orientations of the conducting particles or any combination thereof.

In an embodiment, at least one radiation absorption piece has a polymer substrate doped with carbon particles.

In an embodiment, the connector assembly comprises a connector block received in the shroud, the connector block comprising pins for carrying power or communications data.

In an embodiment, the connector block is surrounded by a conductive shield, the shield being connected to the foil layer of the shroud within the connector assembly.

In an embodiment, the connector assembly comprises guide pillars or guide sockets for providing alignment and/or grounding when mating with a mating connector. The guide pillars or guide sockets may have a grounding strip for making electrical contact with a corresponding grounding strip on the other guide pillar or guide socket to which it connects. Further, the ground strips may be connected to the foil layer of the shroud within the connector assembly.

In an embodiment, the connector assembly has one or more guide pillar or dowel arranged to be received within a corresponding hole in a circuit board to which the connector assembly is to be attached. This helps align the connector assembly during assembly to a circuit board, particularly when using "pick and place" automation, and is particularly useful where the connector assembly is a surface mount connector having pads for connecting to pads on the circuit board using a solder flow process for example.

According to a second aspect of the present disclosure, there is provided a connector assembly comprising:

a body;

a plurality of radio frequency connectors at least partially received in the body; and, a conductive foil integrally formed with the body and partially extending beyond the body.

The conductive foils can serve to shield the connector assembly and/or make a continuous ground to an adjacent connector assembly or to the ground plane of a circuit board. The conductive foil may extend within the connector assembly and form pockets in which pieces of radiation absorbent material may be disposed, which may be different for each pocket and/or for subsets of connectors within each pocket.

According to a third aspect of the present disclosure, there is provided a circuit board assembly comprising a printed circuit board and a connector assembly as described above mounted to the printed circuit board.

In an embodiment, a grounding foil of the connector wraps onto a ground plane of the printed circuit board and makes electrical contact.

In an embodiment, plural connector assemblies are mounted to the printed circuit board, wherein a grounding foil of one connector assembly wraps over onto an adjacent connector assembly and makes electrical contact with a ground foil of that connector assembly.

In an embodiment, plural pockets are formed in the connector assembly containing subsets of RF connectors, wherein the circuit is adapted to receive different signals on the RF connectors in the two pockets.

According to a fourth aspect of the present disclosure, there is provided a cable assembly comprising a connector assembly as described above and a cable connected to the connector assembly.

According to a fifth aspect of the present disclosure, there is provided a method of manufacturing a connector assembly as described above, comprising positioning RF connectors in a mould and moulding one or more layers of radiowave absorption material around the RF connectors.

It will be appreciated that any features expressed herein as being provided "in one example" or "in an embodiment" or as being "preferable" may be provided in combination with any one or more other such features together with any one or more of the aspects of the disclosure.

BRIEF DESCRIPTION OF DRAWINGS

Exemplary embodiments of the present disclosure will now be described by way of example with reference to the accompanying drawings, in which.

DETAILED DESCRIPTION OF DISCLOSED EXEMPLARY EMBODIMENTS

Figure 1:
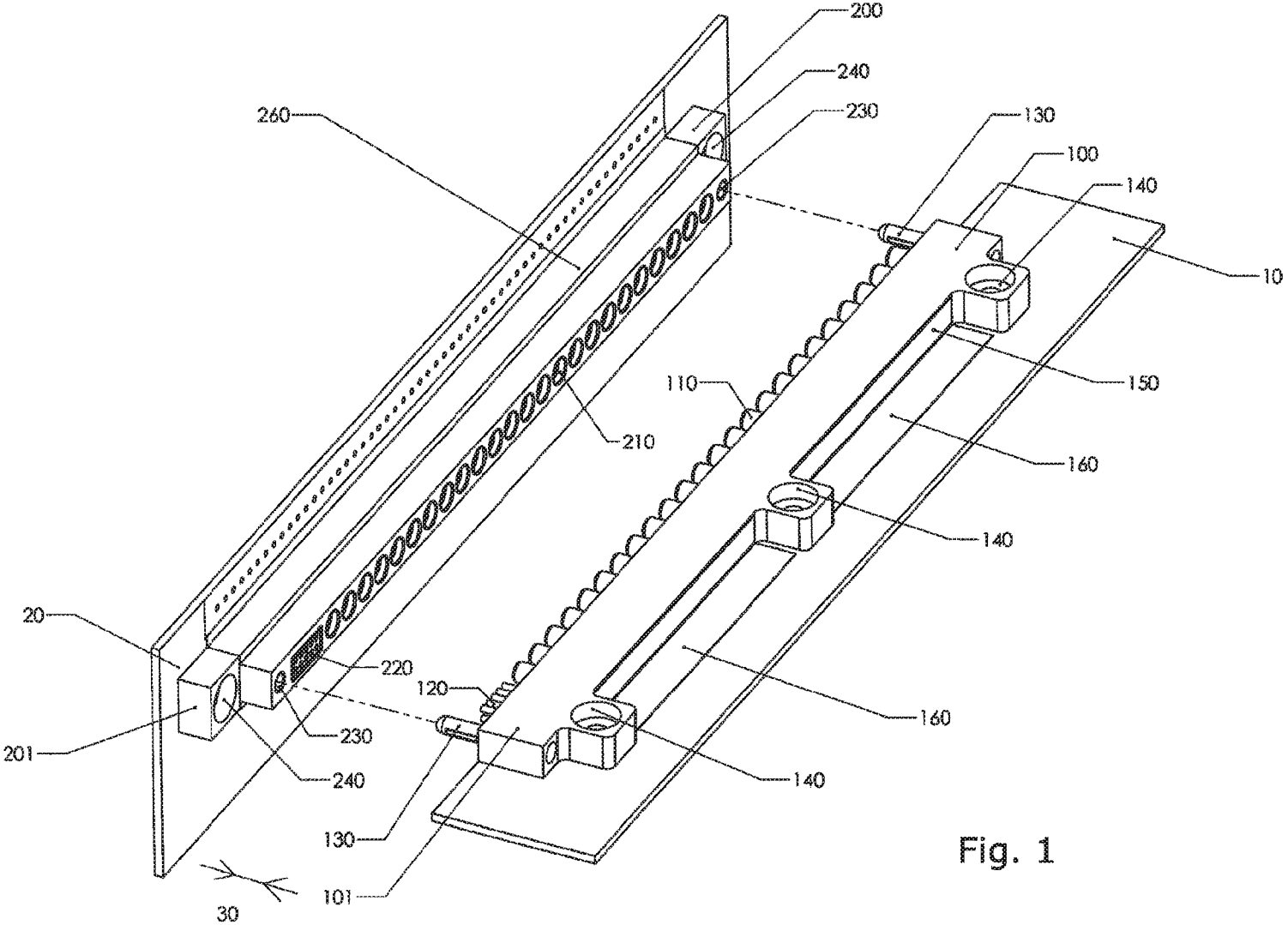
FIG. 1 shows a projection of a male and female connector assembly, each according to the embodiments of the present disclosure.

FIGS. 1 to 4 show a circuit board assembly 1 in which a first circuit board 10 has a male connector assembly 100, and a second circuit board 20 has a female connector assembly 200, wherein the male and female connector assemblies 100,200 are arranged to mate with each other to connect together the two circuit board 10,20. In the present example, the second circuit board 20 is a backplane and the first circuit board is a daughter card which plugs into the backplane at 90 degrees. Accordingly, the male connector assembly 100 is at an edge of the first circuit board 10 and has a mating direction 30 parallel to the circuit board 10, whilst the female connector 200 on the backplane 20 has a mating direction 30 at 90 degrees to the board 20. As will be apparent from the following description, these circuit boards can be used in other applications and configurations.

Figure 2:
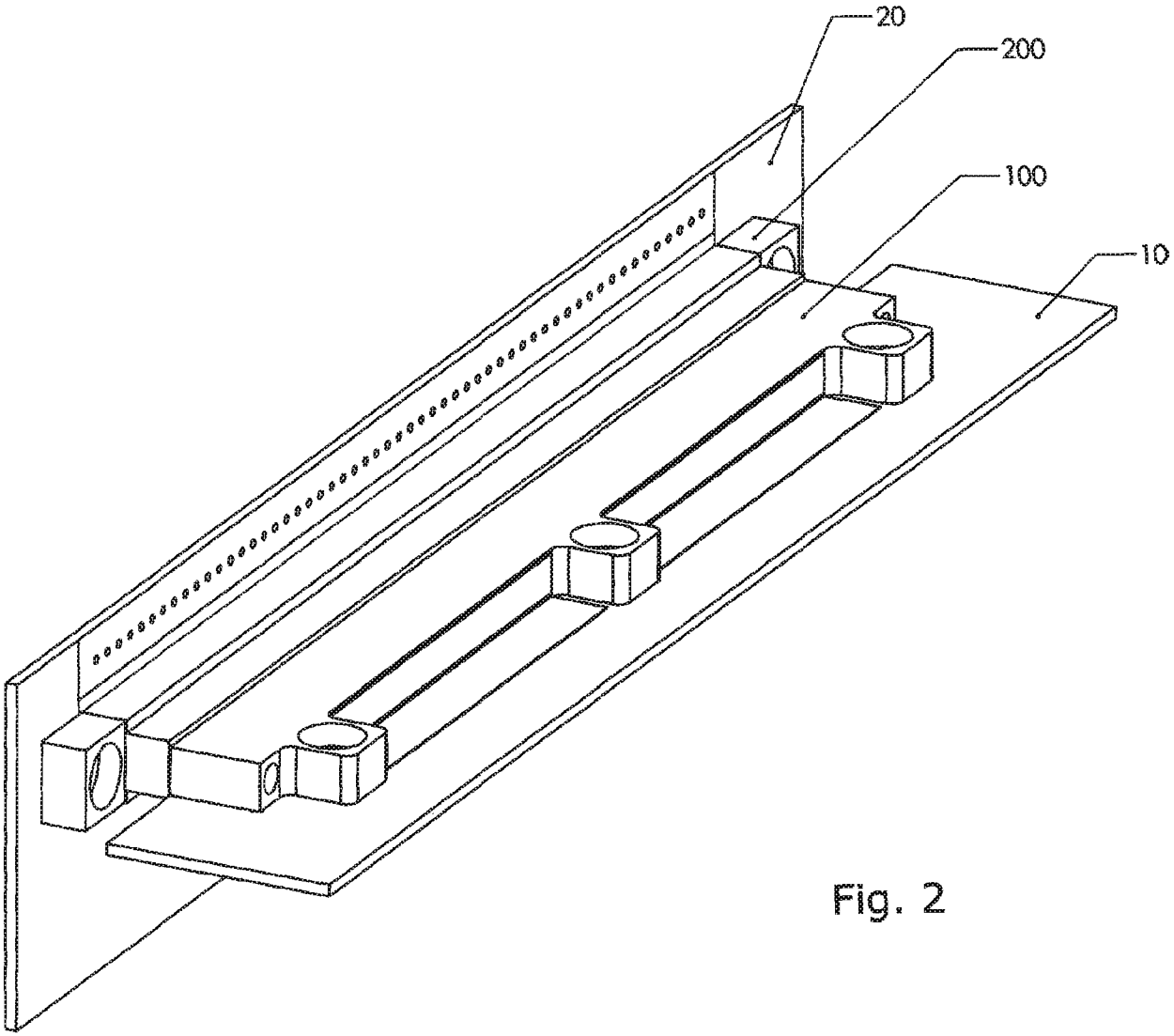
FIG. 2 shows a projection of the male and female connector assemblies of FIG. 1 when connected.

FIG. 1 shows the connectors aligned for mating, whilst FIG. 2 shows the mated connectors connecting the circuit boards 10, 20 together. The connectors may have "snap lock" components (not shown) to retain them in the mated position.

Figure 3:
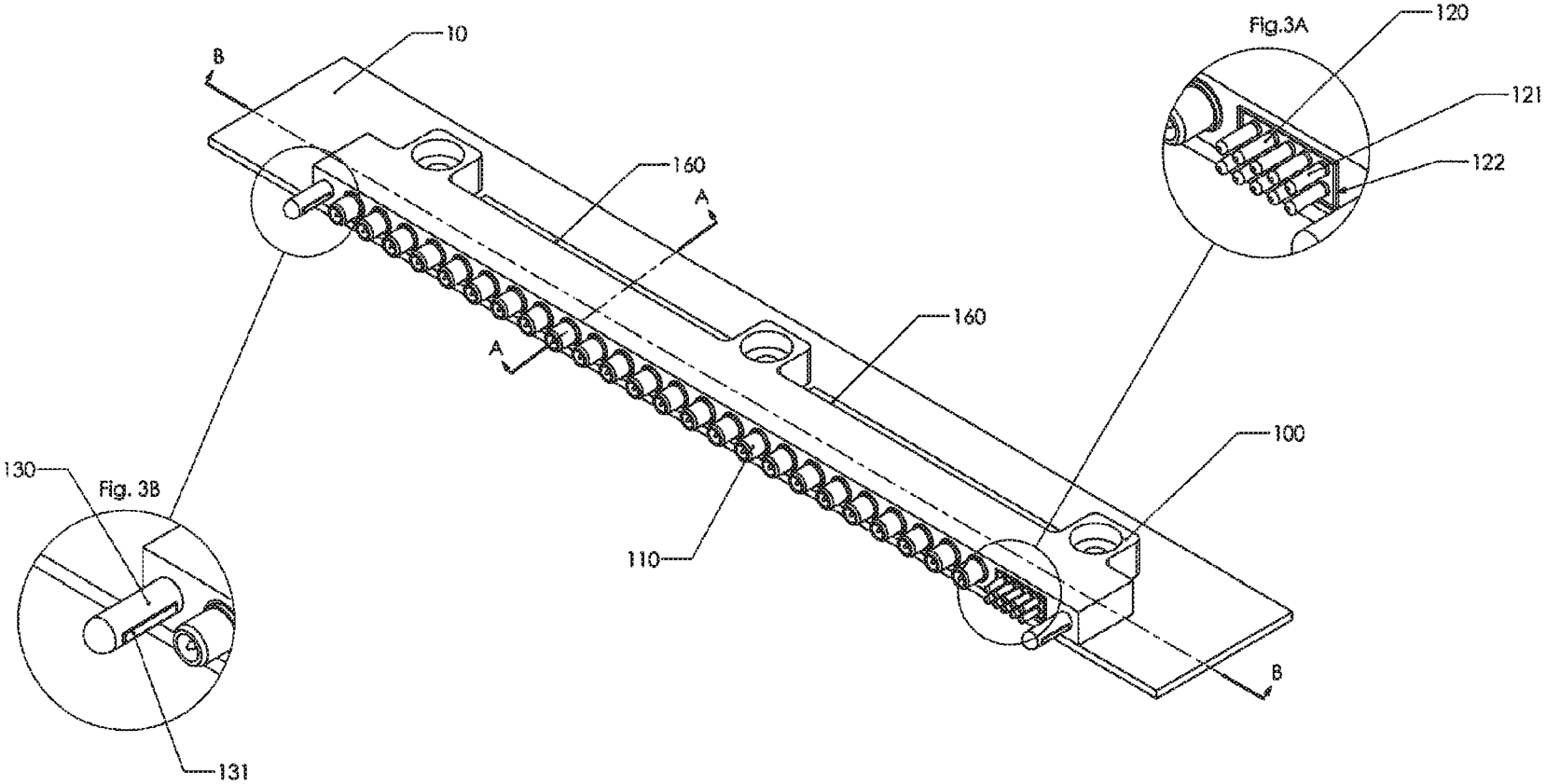
FIG. 3 shows a projection of the female connector assembly of FIG. 1, with FIGS. 3A and 3B showing details of the connector assembly from FIG. 3.

Referring to FIG. 3, the male connector assembly 100 comprises a body 101. The connector has an array of male RF (Radio Frequency) connectors 110 which, in this example, are coaxial connectors. The connector assembly 100 also has a DC (direct current) power and communications port 120, comprising plural pins 121 carrying power and/or communication signals, as shown by the detailed view of FIG. 3A. The connector assembly also has guide pins 130, as shown by FIG. 3B, for guiding the connector 100 as it mates with the female connector 200. The connector assembly 100 also has mounting holes 140 in the body 101, by which the connector 100 can be mechanically fastened to the circuit board 10.

Figure 4:
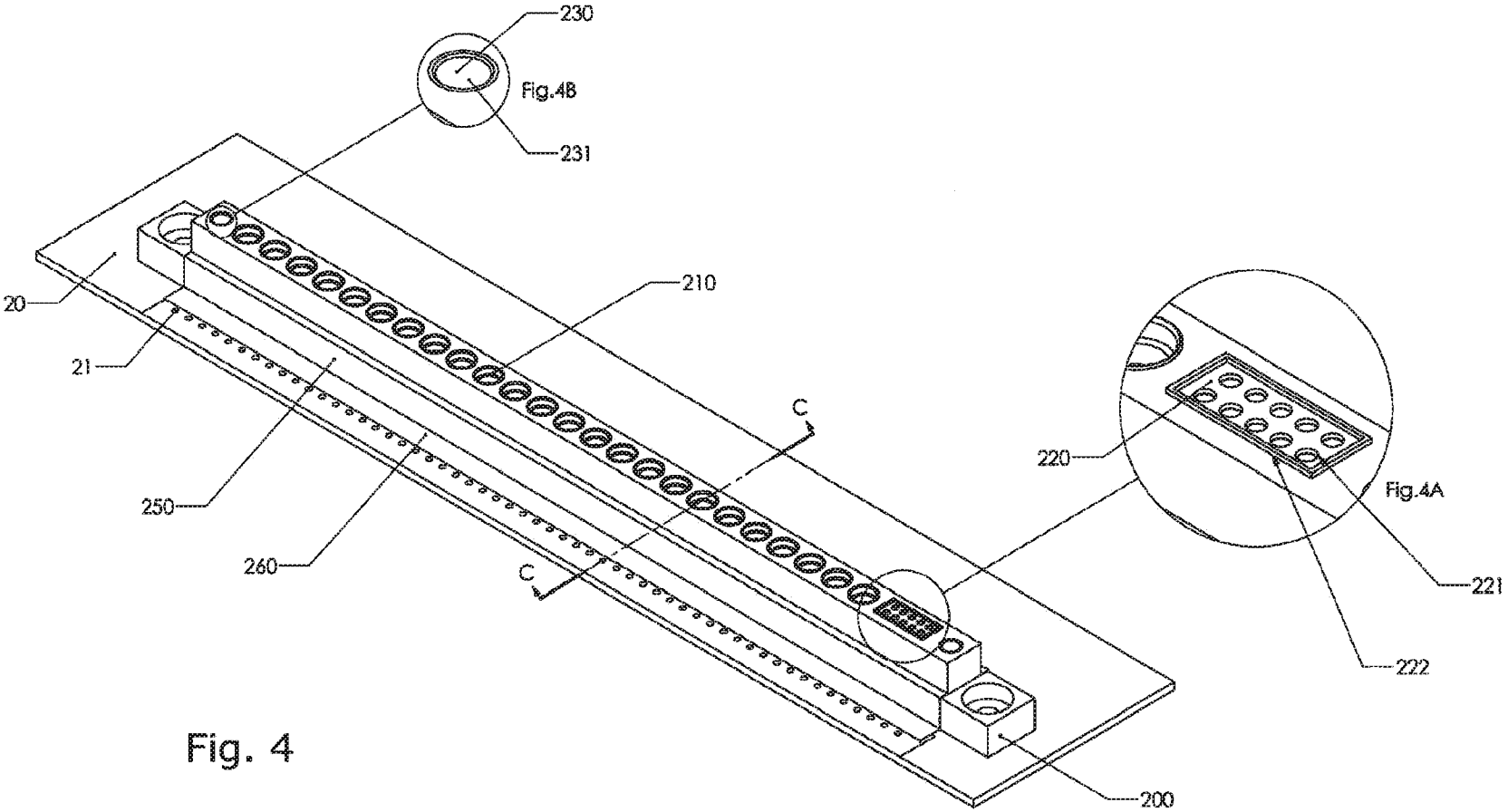
FIG. 4 shows a projection of the male connector assembly of, FIG. 1, with FIGS. 4A and 4B showing details of the connector assembly from FIG. 4.

Referring to FIG. 4, the female connector assembly 200 is generally similar in construction to the male connector 100 except having corresponding female connectors to mate with the male connectors of the male connector assembly 100. Thus, the female connector assembly 200 has a body 201 having mounting holes 240 by which it is mechanically fastened to the underlying circuit board 20. The female connector assembly 200 has an array 210 of female RF connectors, for connection with the male RF connectors 110. The female connector assembly 200 has a female DC power and communications port 220, as shown by FIG. 4A, for connecting to the male power and communication port 120 of the male connector assembly 100.

The female connector assembly 200 also has guide holes 230, as shown by FIG. 4B, for receiving the guide pins 130 of the male connector assembly 100. Thus, the male connector assembly 100 is advanced towards the female connector assembly 200, the guide pins 130 locate the guide holes 230 and thereby align the connector assemblies 100, 200 to help make a smooth connection between the arrays of RF connectors 110, 210 and power/communication ports 120, 220. The leading end of the guide posts 130 and/or the rim of guide hole 230 may be tapered or rounded to help locate the guide posts in the guide holes. The guide posts 130 have a grounding strip 131 which makes contact with a corresponding ground strip 231 in the guide hole 230 to provide ground continuity between the two connectors. The grounding strips 131, 231 extend through the body of the connector and make contact with the ground plane of the circuit board, e.g. by a soldered or otherwise bonded connection. Thus, ground continuity can be provided through the connection.

As can be seen, in the present example, the male connector assembly 100 is a right angle connector, i.e. extending from the surface of the circuit board, the RF connectors undergo a 90 degree bend to achieve a mating direction that is parallel to the underlying circuit board 10. The female connector assembly 200 in contrast is a straight connector, i.e. extending straight from the surface of the circuit board to achieve a mating direction that is perpendicular to the circuit board 20. Thus, this arrangement and positioning of connectors 100,200 allows the first circuit board 10 to be connected to the second circuit board 20 at a perpendicular angle, e.g. for allowing one or more circuit board to plug into a backplane. However, it will be appreciated that other arrangements can be made.

As described in more detail below, the connector assemblies 100, 200 also each comprise a shroud 150,250 within the body 110,210 of the connector assemblies 100,200 which generally provides shielding and attenuation of RF electromagnetic energy to and from the connector.

Figure 5:
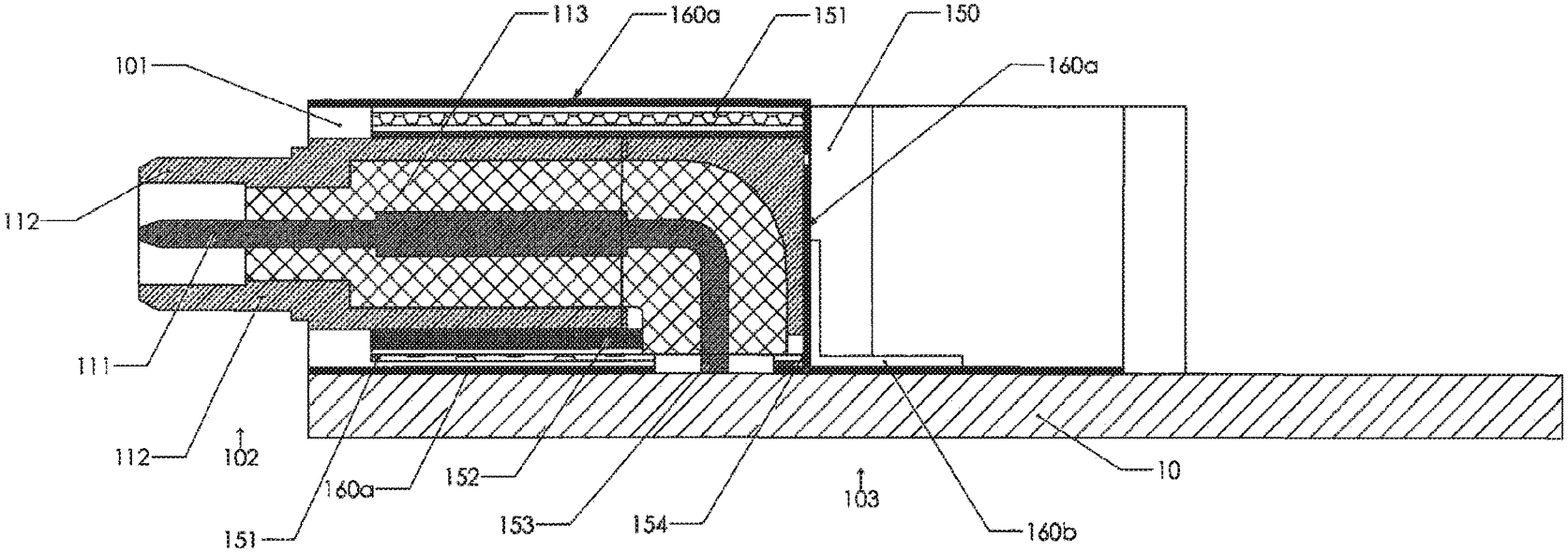
FIG. 5 shows a cross-section of the male connector assembly of FIG. 3, taken along line A-A.
Figure 6:
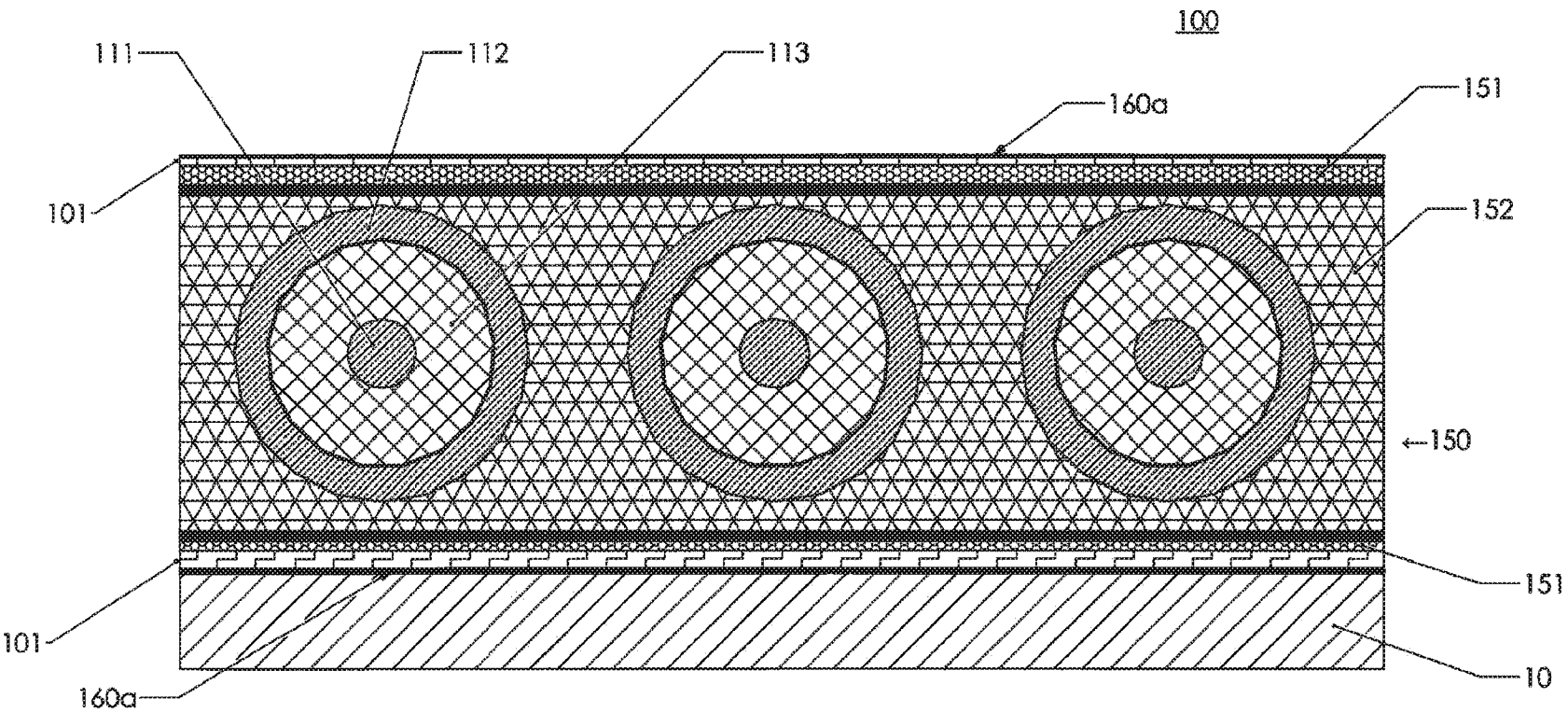
FIG. 6 shows a cross-section of the male connector assembly of FIG. 3, taken along line B-B.

FIG. 5 shows a cross-section of the male connector 100, taken along lines A-A in FIG. 3, and FIG. 6 shows a longitudinal cross-section, taken along lines B-B in FIG. 3. The RF connector 110 comprises a pair of conducting elements for carrying the RF signal. In this example, the RF connector is a coaxial connector having a central conductor element 111 and a conductive outer shield 112, in the shape of a barrel surrounding the central conductor element 111, separated by an insulating material 113. Typically, the outer shell 112 provides a signal ground and the conducting element 111 carries the signal.

At the front 102 of the connector assembly 100, the conductive elements 111,112 extend beyond the body 101 of the connector assembly 100 forming a male RF connector 110 arranged to mate with a corresponding female connector 210. The central element 111 and outer shell 112 extend through the body of the connector assembly 100 towards the rear 103 of the connector assembly 100 where they form terminals 153,154 on the underside of the connector assembly 100 for connection to the circuit board 10. The central element 111 and outer shell 112 extends rearwardly and then bends through 90° to extend towards the circuit board 10, where the central element terminal 154 is soldered or otherwise bonded to the signal path trace in the circuit board 10 and the outer shell terminal 153 is soldered or otherwise bonded to the ground plane on the circuit board 10.

The RF connectors 110 can be of any suitable type as are generally known and commercially available. Commonly the connector parts are formed from a base metal plated with a different metal for various reasons, i.e. to improve the electrical and thermal conductivity, to improve the contact between conductors, and even to improve the solderability or weldability of a part. A huge number of metals are available and potentially suitable. For instance, the base material may be Beryllium Copper or Brass or some other copper based alloy, with a thin layer of gold or some other Nobel metal to take advantage of the electrical and thermal properties of the plated metal while using as little of the material as possible. The insulating material 113 may be formed from Polyethylene (PE), Polytetrafluorethylene (PTFE), or the like.

Figure 10:
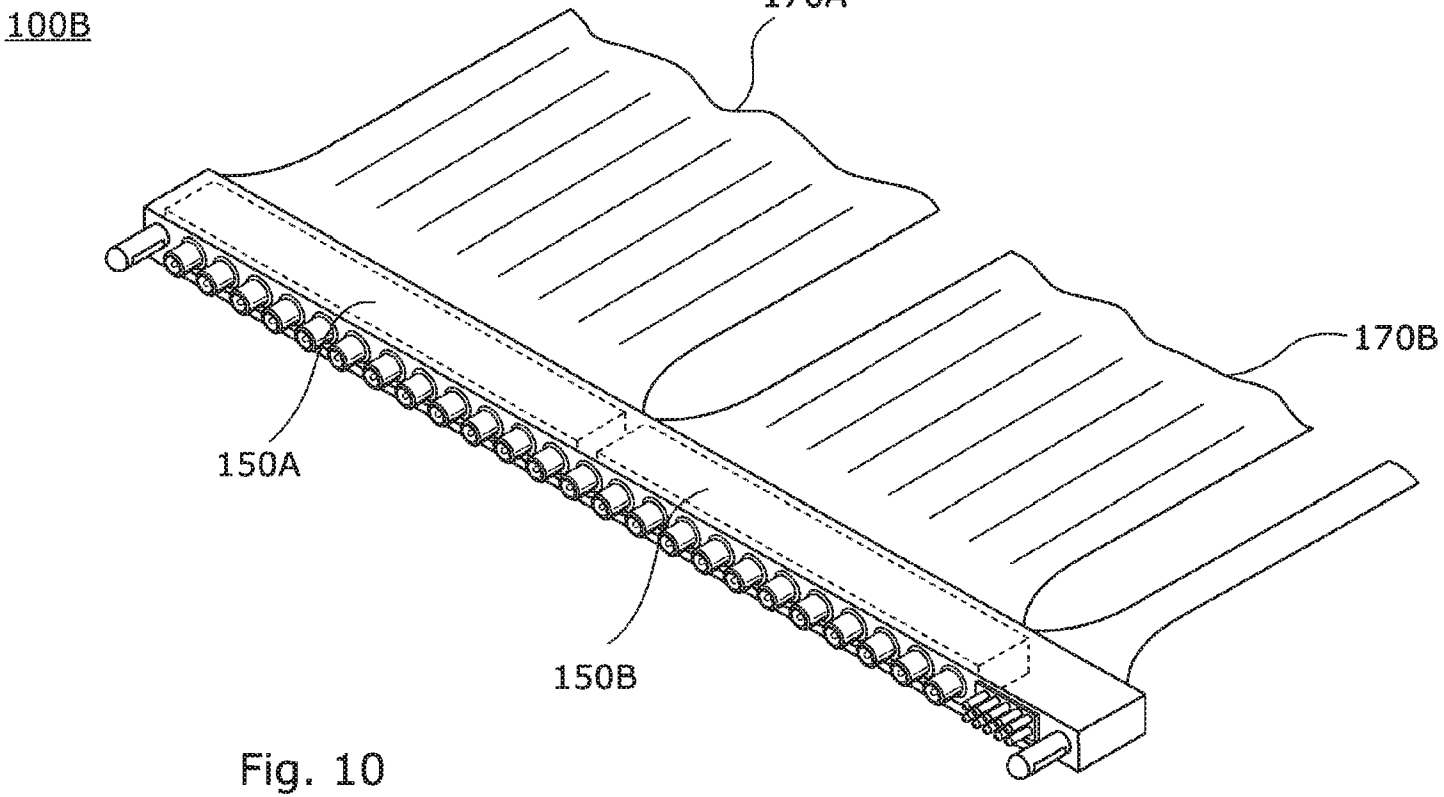

In this example, the terminals 153,154 are soldered or otherwise bonded to the circuit board 10—however it will be appreciated that different attachments can be formed, e.g. the connector assembly can be attached to a PCB (as shown in FIGS. 1 to 4) or to a cable to form a cable assembly (as shown in FIG. 10) to provide board-to-board, board-to-cable, or cable-to-cable connections. The mechanical and electrical attachment of the connector to a PCB or a cable can be made by a solder, a press-fit or a crimp process. Where soldering is used, the terminals 153, 154 of the connector assembly 100 may be through-hole terminals arranged to extend through the circuit board or surface mount pads arranged to be soldered or otherwise bonded to pads on the surface of the circuit board. The attachment of cables to usually requires a crimp tool to crimp the terminals to the cable (cold welding).

Where surface mount technology is used, the cable assembly 100, 200 may include one or, in other instances, at least two pillars or dowels extending from the connector assembly 100, 200 for being received in holes in the circuit board to help position the connector assembly 100, 200 accurately on the board prior to making the solder connection. This is particularly useful when using "pick and place" automation during the manufacturing process.

The connector assembly 100 comprises a shroud 150 either forming or contained within the body 101 of the connector assembly 100. The shroud 150 shields the RF connector 110 and attenuates RF energy. In an embodiment, the shroud 150 comprises plural pieces. In the present example, the shroud comprises plural layers of Radiation Absorbent Material (RAM) and integral conductive foil layers, e.g. made of thin metal foils or the like (e.g. preferably having a thickness between 50 μm and 300 μm.) The shroud has a first RAM layer of type A 151 a second layer of Radiation Absorbent Material (RAM) of type B 152 and a third layer of doped Radiation Absorbent Material (RAM) of type A 151. The shroud has a thin foil of conducting material 160*a*, e.g. a 100 μm metal foil layer extending around the top, bottom and rear surfaces. The foil layer can be plated onto the layers or RAM or a separate foil layer bonded on. The thin foil layers 160*a* can extend between the layers of RAM within the shroud. The thin foil layers 160*a* may be plated onto the surfaces of the RAM layers or the body of the connector before they are assembled into the final connector assembly.

As can be seen, in this example, the layers of RAM are generally parallel with the array of RF connectors 110. In this example, the RF connectors 110 and communication ports 130 are contained within the second layer of RAM 152. This layer of RAM 152 absorbs RF energy leaking out of the RF connectors 110 and helps prevent crosstalk between adjacent RF connectors 110.

The outer layers of RAM 152 offer a safe guard against radiation leaking from the connector and absorbing radiation. The outer layers of RAM 152 have different doping and/or properties from the central layer of RAM 151, such that they are adapted to adsorb radiation of different frequencies. Thus, by choosing the RAM materials, according to the expected signal frequencies carried by the connectors, the shroud 150 can be tailored to absorb the radiation dissipated by the type of signals carried by the connector assembly 100.

The thickness required for the layers of RAM to absorb RF energy will depend to some degree on the application and the RF spectrum of the signal being carried. However, typically, layers of between 0.5 mm and 3 mm are expected to be used in most practical applications, In many applications a single layer of RAM will be sufficient. However multiple layers of RAM is beneficial in cases where it is desired to achieve attenuation of leaked RF energy over very broad frequency range. The reason for this is that RAM can be frequency selective. What attenuates 1 GHz RF signal extremely well will not work as well at 50 GHz. Having multiple layers will provide multiple attenuation paths, each selectively optimised to attenuate specific frequency or frequency bands. This feature is applicable in applications where the connector design is intended to cover a broad frequency spectrum.

The layers of conductive material 160 at the boundary of the second RAM layer 151 helps shield the connector from external radiation and prevent radiation from leaking from the RF connectors 110 to external components or adjacent connectors. The thin conducting material 160*a* extends around the back edge of the connector, helping shield the back 103 of the connector from radiation. If desired, the thin conductive material 160*a* may form compartments within the shroud 150 each containing different RAM material for absorbing RF energy in different frequency ranges. For instance, the three layers of RAM shown in FIGS. 5 and 6 can have a conductive layer 160*a* separating them. As described below the thin conductive material 160*a* can extend beyond the body of the connector as a foil layer 160*b* which can be used to help ground the shroud to the PCB 10 or neighbouring connectors which helps control EMC (Electromagnetic Compatibility).

As described in more detail below in relation to FIG. 10, compartments (also referred to as pockets herein) can be formed around subsets of the RF connectors (i.e. one or more RF connectors), which can be particularly useful where the connectors 110 carry different signal types in use having different RF spectra.

Another advantage to providing the foil layers is that it helps conduct heat away from the shroud 150. The RAM material operates by turning RF energy into heat energy. The use of foil layers next to the surface of RAM pieces can help conduct away the generated heat. This helps improve the performance of the RAM materials in absorbing radiation.

In some embodiments, there is a single ground potential in the connector. Thus, the conductive foil layers 160 within the shroud, the ground strips 131 on the posts/holes and the ground layer 122 surrounding the connector block 120 will all be electrically connected within the connector assembly 100, together with the outer shields 112 of the RF connectors.

As shown by FIG. 5, the end of the central conductor 101 passes through a gap in the shroud 150 so as not to make electrical contact with the layers of the shroud 150.

A section of foil layer 160*b*, e.g. having a thickness of 300 μm, extends beyond the body 110 of the connector 110 forming a grounding blanket. As shown in FIG. 5, this extending portion of foil can be soldered or bonded to the ground plane on the circuit board 10, so as to ground the shield in the shroud 150. Alternatively, the foil 160*b* can be connected to an adjacent connector assembly where plural connector assemblies are mounted in dose proximity on the circuit board. Thus, the foil layer can also help with ground continuity between the connector ground and external grounds. In some embodiments, it is preferable that all ground points within the connector assembly 100 be connected together within the connector. Thus, in such embodiments, the foil layers 106*a*,160*b* are all connected together and furthermore can be used to connect the ground strips 131 in the guide posts 130, the shield 122 around the connector block 120, the RF connector shells 112 and/or any other elements intended to be at ground potential, or any combination thereof.

Figure 7:
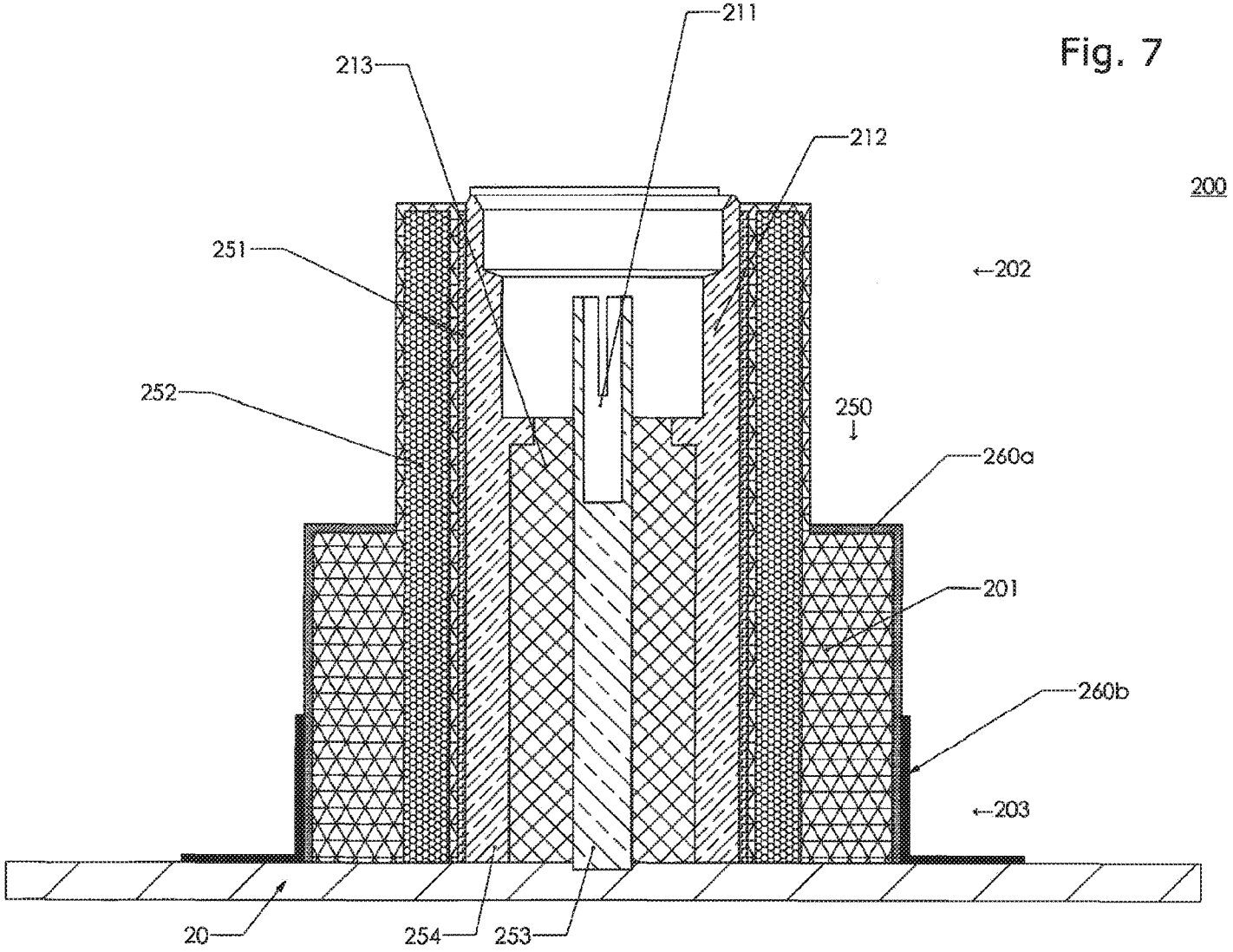
FIG. 7 shows a cross section of the female connector assembly of FIG. 4, taken along line C-C.

FIG. 7 shows a cross section though the female connectors 210, along line C-C, as shown in FIG. 4. The female connector assembly 200 has a shroud 250 in a similar arrangement to the male connector assembly 100 as shown in FIG. 5. Thus, the female RF connector 200 comprises a central element 211 surrounded by a connector barrel 212, separated by a dielectric 213. In this example, the RF connectors form a female connector at the front 202 of the connector assembly 200 for connecting to a male connector and extend straight through the body of the connector 200 to form terminals 253,254 at the rear 203 of the connector assembly for mounting to the underlying circuit board 20. The body of the connector 200 comprises a shroud 250 comprising various layers of RAM material and metallic foils. In a similar arrangement to the male connector 100, the female connector 200 has a shroud 250 comprising plural layers of Radiation Absorbent Material (RAM). The shroud 250 has a first RAM layer of type A 251, a second layer of Radiation Absorbent Material (RAM) of type B 252 and a third layer of doped Radiation Absorbent Material (RAM) of type A 251. The layers are generally parallel with the array of RF connectors 110.

The RF connectors 210 and communication ports 230 are contained within the second, central layer of RAM 152 which extends from the rear 203 of the connector assembly, adjacent the circuit board 20, along the sides of the RF connector to the front 202 of the connector assembly. The first and third layers of RAM 252 extend from the rear 203 of the connector assembly, adjacent the circuit board 20, along the sides of second, central layer of RAM 251 connector to the front 204 of the connector assembly 200. The shroud 250 is held within the body 201 of the connector assembly 200, which generally extends from the circuit board to approximately half way up the connector.

In this example, the foil layer 260*a* extends around the outer body 201 of the connector to provide a conductive blanket shielding the connector assembly 200. However, if desired, the foil layer can additionally or alternatively extend within the shroud 250 about the boundaries of the layers of RAM to provide shielding, ground continuity and heat conduction as described above for the male connector 100.

Figure 8:
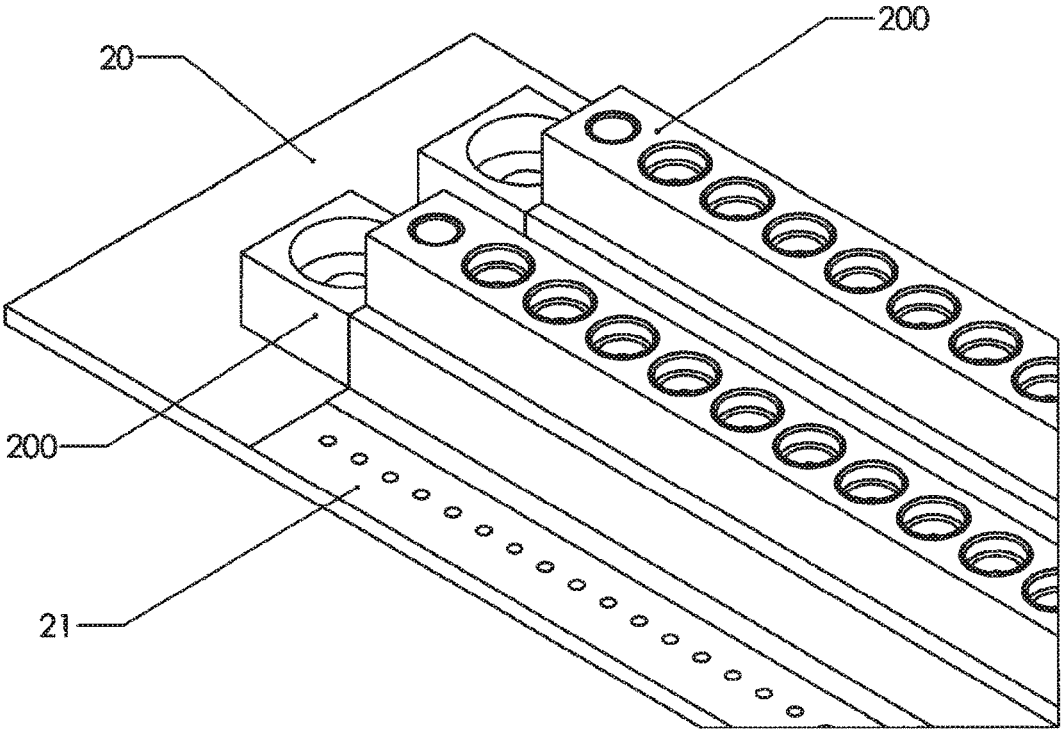
FIG. 8 shows a projection of two adjacent female connector assemblies mounted to a circuit board according to embodiments of the present disclosure.
Figure 9:
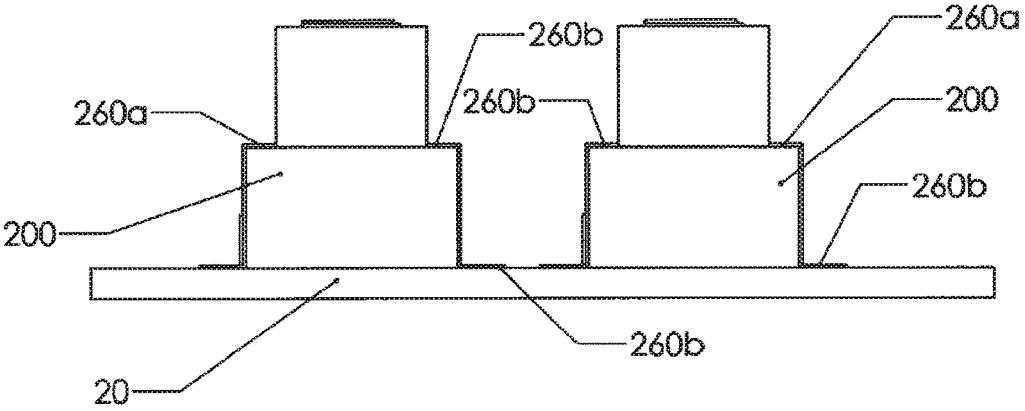
FIG. 9 shows a side plan view of the connector assemblies of FIG. 8; and, FIG. 10 shows a projection view of a connector assembly as part of a cable assembly according to an embodiment of the present disclosure.

As shown by FIGS. 8 and 9, part of the foil layer 260*b* extends beyond the body of the connector and can be bonded onto the PCB ground layer 21 and/or can also be bonded to the grounding foil of an adjacent connector assembly.

The connector assembly 100, 200 can be manufactured by using a moulding process. As the RF connector 110 and DC connector 120 can be introduced into a mould together and the various layers of the shroud and the body of the connector can be build up with a moulding process. The layers of foil can be plated on the layers of RAM or separately introduced around the periphery of the layers as they are bunt up when assembling the connector assembly. A thermoplastic or the like can be over moulded to form the body to provide additional structure to the body of the connector.

Thus, in exemplary embodiments described above, a connector assembly 100, 200 is provided that advantageously uses radiowave absorption material in forming a shroud to attenuate RF energy, e.g. by converting it to heat, and greatly reduces leakage between adjacent RF connectors and thus increases the isolation of each RF connectors.

Additionally or alternatively, foil layers can be integrally provided within the connector assembly to shield the various connectors, conduct heat away from the RAM layers and provide ground continuity between elements of the connector assembly and/or with external ground elements. This allow a high density of RF connectors within the connector assembly whilst minimising cross talk and other signal interference. Thus, the disclosed connector assembly 100, 200 can be miniaturised without suffering from the signal degradation problems that afflict the prior art attempts. For instance, in certain exemplary embodiments, the RF connectors may be less than 1 mm apart for instance. The connector assembly may have an array of at least 5, at least 10, at least 20 or more RF connectors. These may be arranged in a single row, or more than one row for example.

It will be appreciated that modifications can be made to the structure of the connector assembly that are different from the detailed examples given in this document. The RAM pieces could have different numbers, orientations and shapes to those shown. For instance, a cylindrical layer of RAM could be provided around each RF connector, i.e. around the cylindrical shield, and secondary layers having a different material could be provided above and below. Different arrangements of connector ports can be possible within any one particular connector assembly.

The connector assemblies may be made modular by arranging the RF connectors in sub-sets (known as "constellations" in the terminology of the art). For example, the connector assemblies of FIGS. 1 to 4 can be sub divided into subsets of, for example, 8 or 12 connectors each having a different function or carrying different signal types.

FIG. 10 shows an example of a male connector assembly 100B as part of a cable harness assembly in which the RF connectors are split into two constellations of 12 connectors each corresponding to a different cable 170A,1703. Each constellation of RF connectors has a separate shroud 150A, 1503, which may be surrounded by a foil layer forming a pocket (shown by broken line in FIG. 10), allowing the properties of the shroud to be tailored for each constellation by varying the type and arrangement of RAM layers.

The connector assemblies can be used to connect cables or circuit boards, or cable to board. The connector assemblies can be male or female, straight or right angle connectors.

Exemplary embodiments of the present invention have been described with particular reference to the example illustrated in the drawings. However, it will be appreciated that variations and modifications may be made to the examples described and are within the scope of the present invention, which is defined by the claims set out below.

The invention claimed is:

1. A connector assembly comprising:

a shroud; and, a plurality of co-axial radio frequency connectors at least partially received in the shroud such that the shroud extends around each radio frequency connector and between adjacent radio frequency (RF) connectors, each co-axial connector having a first end arranged to mate to a corresponding other co-axial connector and a second end having surface mount terminals for being soldered to a circuit board, wherein the shroud has a planar surface surrounding the second end arranged to abut the circuit board when soldered to the circuit board in use, and wherein the shroud is molded around the co-axial connectors and completely encapsulates the co-axial connectors between the first end and the second end, wherein the shroud comprises at least one piece of radiowave absorption material arranged to absorb radio frequency energy leaking or dispersing from the radio frequency connectors in use wherein the radiowave absorption material is selected to absorb an expected signal frequency carried by the radio frequency connectors.

2. A connector assembly according to claim 1, wherein the shroud comprises plural pieces of radiowave absorption material, at least one piece of the plural pieces of radiowave absorption material having different RF energy absorption properties from another piece of the plural pieces of radiowave absorption material.

3. A connector assembly according to claim 1, wherein the RF connectors have a front portion for mating to a corresponding other connector and a rear portion having terminals for making electrical connection to a circuit board, wherein the shroud extends around at least the rear portion of the connector assembly.

4. A connector assembly according to claim 1, wherein a first piece of radiowave absorption material (RAM) of a first type is sandwiched by pieces of RAM of a second type.

5. A connector assembly according to claim 1, wherein one or more pieces of radiowave absorption material is arranged in a layer.

6. A connector assembly according to claim 1, comprising a body, the body holding the shroud and being formed from a different material to the shroud which has a relatively low ability to absorb RF energy compared with the shroud.

7. A connector assembly according to claim 1, wherein the shroud comprises a conductive foil layer formed integrally with the connector assembly.

8. A connector assembly according to claim 7, wherein the conductive foil layer is positioned adjacent to a surface portion of at least one piece of radiowave absorption material.

9. A connector assembly according to claim 8, wherein the conductive foil layer is positioned between two pieces of radiowave absorption material.

10. A connector assembly according to claim 7, wherein the conductive foil layer surrounds a rear portion of the RF connectors and wherein the conductive foil layer is wrapped around at least part of a surface of the connector assembly.

11. A connector assembly according to claim 7, wherein the conductive foil layer extends beyond a body of the connector assembly such that the conductive foil layer can be joined to a ground plane of a circuit board.

12. A connector assembly according to claim 7, wherein the conductive foil layer defines at least one pocket containing one or more pieces of radiowave absorption material.

13. A connector assembly according to claim 7, wherein the conductive foil layer defines plural pockets, each containing one or more pieces of radiowave absorption material, wherein the plural pockets are arranged to absorb RF energy having respectively different frequencies.

14. A connector assembly according to claim 13, wherein the plural pockets are arranged to absorb the RF energy from respective different subsets of the RF connectors.

15. A connector assembly according to claim 1, wherein the at least one piece of radiowave absorption material comprises a composite material formed from a substrate doped with conducting particles.

16. A circuit board assembly comprising a printed circuit board and a connector assembly according to claim 1 mounted to the printed circuit board.

17. A circuit board assembly according to claim 16, wherein a grounding foil of the connector assembly wraps over and onto an adjacent connector assembly on the circuit board and makes electrical contact with a ground foil of the adjacent connector assembly.

18. A circuit board assembly according to claim 17, wherein plural pockets are formed in the connector assembly containing subsets of RF connectors, wherein the circuit board is adapted to receive different signals on the RF connectors in the two pockets.

19. A method of manufacturing a connector assembly according to claim 1, comprising positioning RF connectors in a mold and molding one or more layers of radiowave absorption material around the RF connectors.

* * * * *